United States Patent [19]

Fathauer

[11] 3,944,272

[45] Mar. 16, 1976

[54] CARGO CONTAINER SPREADER WITH ARTICULATED STRUCTURE FOR SKEWING AND TILTING

[75] Inventor: Jack E. Fathauer, Roxboro, N.C.

[73] Assignee: Midland-Ross Corporation, Cleveland, Ohio

[22] Filed: Aug. 12, 1974

[21] Appl. No.: 496,337

[52] U.S. Cl. ..... 294/81 SF; 294/67 DA

[51] Int. Cl.[2] ..... B66C 1/66

[58] Field of Search..... 294/67 R, 67 BB, 67 BC, 294/67 DA, 67 DB, 81 R, 81 SF; 212/11, 13, 14, 41, 77, 83, 125; 214/394, 396, 620, 621, 654

[56] References Cited

UNITED STATES PATENTS

| | | | |
|---|---|---|---|
| 3,042,227 | 7/1962 | Tantlinger | 294/81 SF UX |
| 3,387,729 | 6/1968 | Hindin et al. | 294/67 R X |
| 3,520,431 | 7/1970 | Tax | 294/67 R X |
| 3,656,795 | 4/1972 | White et al. | 294/67 R |
| 3,789,998 | 2/1974 | Fathauer et al. | 294/81 SF X |

*Primary Examiner*—Evon C. Blunk
*Assistant Examiner*—Johnny D. Cherry
*Attorney, Agent, or Firm*—Woodrow W. Portz

[57] ABSTRACT

Disclosed herein is a cargo container spreader arranged as an articulated assembly of which a main frame or spreader portions supporting a cargo container may be shifted in substantially universal angular movements relative to a spreader supporting facility, such as a crane, through suspension of the main frame on a pair of spaced upright subframes with respect to which the main frame is horizontally movable in its transverse direction. Skewing of the main frame occurs when it is shifted relative to the subframes in opposite transverse directions.

9 Claims, 5 Drawing Figures

CARGO CONTAINER SPREADER WITH ARTICULATED STRUCTURE FOR SKEWING AND TILTING

BACKGROUND OF THE INVENTION

The aspect of spreader construction with which the present invention is essentially concerned is that of causing minor rotation of the cargo container about a vertical axis with respect to the crane which supports the spreader. Regarding spreaders which are operated in pendant relation with a crane, the principal arrangement found in the prior art is one in which the spreader comprises two horizontal frames arranged one over the other and connected to each other on a central horizontal pivot joint by expensive massive bearing structure. While this arrangement permits large angular ranges of skewing of the cargo container, e.g., up to 90° relative movement between the two horizontal frames, the present invention recognizes that 15° or 20° of skewing movement is adequate for a vast number of operating environments. With the concept in mind that the small skewing range might be practical, the possibility of building a spreader in accordance with a fundamentally different design has been a paramount motivation of this invention.

The most important object of the invention is to achieve a lower cost design in cargo container spreaders of a type having moderate skewing capability than has been heretofore available to the shipping industry.

Another object is to provide skewable spreaders of compact design.

Still another object is to construct a skewable spreader including self leveling structure with the result that the combination of skewing and tilting capabilities enables the spreader to undergo substantially universal adjustment within the tilting and skewing ranges of the spreader.

SUMMARY OF THE INVENTION

In the simplest form of the invention, a cargo container spreader is provided which has a main frame equipped optionally with, or without, subsidiary telescoping cantilever frames, and latching mechanism to interlock with latch receptacles of a cargo container. The essential feature of the spreader is that it has two upright subframes spaced longitudinally of the spreader at opposite sides of its transverse axis forming hinge joints with the main frame along axes parallel to the transverse axis along which the subframe is traversable transversely relative to the main frame.

In preferred embodiments, each subframe includes a rocking beam pivoted at its middle to an upper middle portion of a stanchion of the subframe in hinged relation with the main frame. The pivotal axis of each beam is parallel to the length of the main frame. Each rocking beam contains a pair of sheaves, one at each end, in journal bearing relation with the rocking beam along axes parallel to the rocking beam axis.

DESCRIPTION OF PREFERRED EMBODIMENTS

Figure 1:
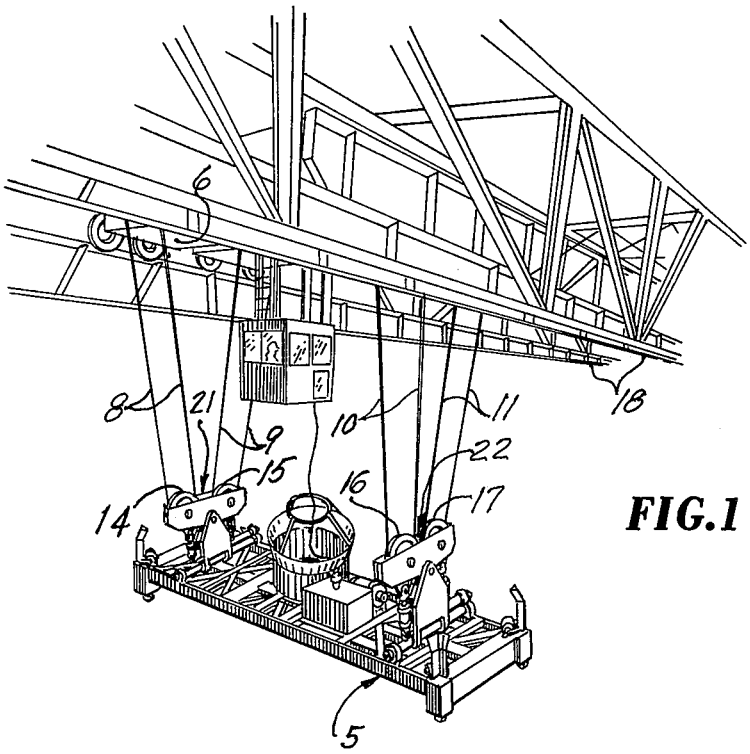
FIG. 1 is a perspective fragmentary view illustrating a spreader in accordance with the invention in typical cable suspension from a traveling overhead crane.

FIG. 1 illustrates a typical crane and spreader installation wherein a spreader 5 is supported by a traveling overhead crane 6 in typical four point suspension wherein cables 8, 9, 10 and 11 are looped around sheaves 14, 15, 16 and 17, respectively. As shown, the crane 6 is supported on tracks 18 along which the entire crane and spreader assembly may travel.

Figure 4:
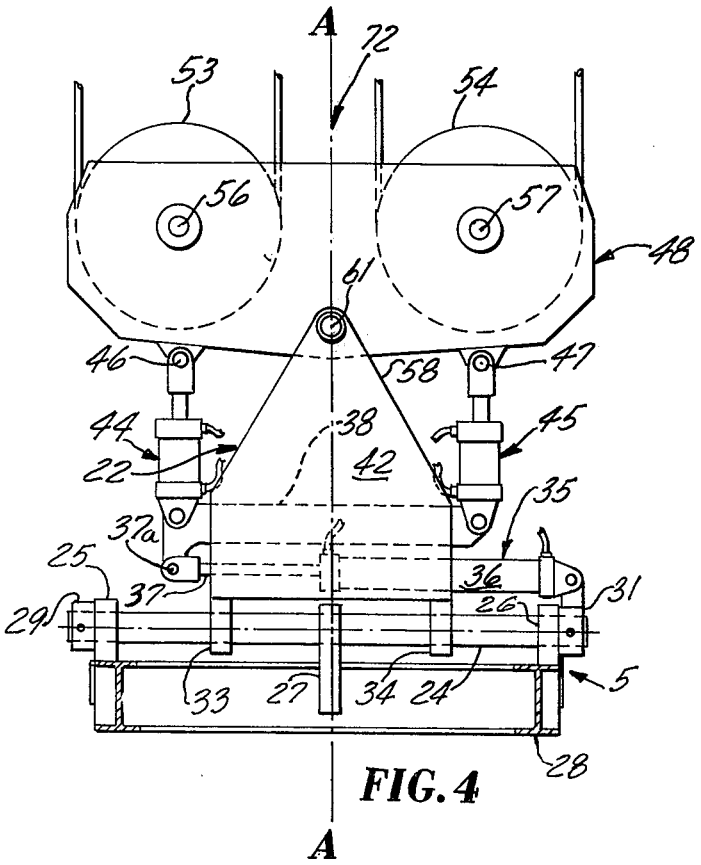
FIGS. 4 and 5 are fragmentary end and side elevations, respectively, of an upright subframe assembly in hinged relation with the main frame of the spreader.
Figure 5:
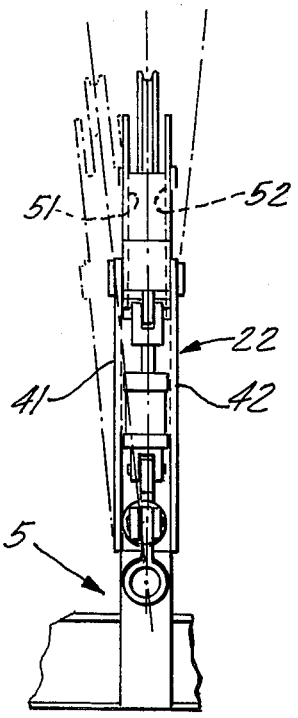

Considering now the advance in the art offered by this invention, the spreader 5 comprises subframes 21,22, shown in more detail in FIGS. 4 and 5. In these figures, it may be noted that the subframe 22, i.e., the assembly comprising a lower stanchion 58 and an upper rocking beam 48 hinged thereto, is swingably supported on a shaft 24 received in bearings 25, 26, 27 fixed to the main frame 28. Endwise movement of the shaft relative to the bearings fixed to the main frame is prevented by collars 29,31 secured to the shaft 24 at the outboard sides of bearings 25,26, respectively. The subframe 22 comprises as its lowermost projections bearings 33,34 which encircle the shaft 24. The bearings 33,34 are in slidably fitting relation with the shaft 24 to enable movement of the subframe lengthwise of the shaft and transversely of the spreader frame in response to operation of a fluid power cylinder or motor 35 received between the two sidewalls of the stanchion 58.

The motor 35 is constructed in a well known manner to provide rectilinear driving motion with fluid containing cylinder 36, an internal piston to which is attached a piston rod 37. As shown, the motor 35 terminates in a clevis end pinned pivotally to an eye-extension of the collar 31. At its piston rod end, it is pinned at **37*a* to a reinforcing bar 38 fixed to and between the sidewalls 41,42 of the subframe 22. The bar 38 extends horizontally beyond the walls to provide projecting end portions to which clevis ends of fluid power cylinders or motors 44,45 may be pivotally attached by the pins as shown. Motors 44,45 extend vertically upward to pivotally connect by way of pins 46,47, respectively, with the rocking beam 48.**

The rocking beam 48 may be constructed in the form of a housing, as shown, with two parallel spaced vertical sidewalls 51,52 between which the sheaves are supported in opposite end portions of the beam on pivotal support, such as axles at axes 56,57, anchored in the walls 51,52. The rocking beam 48 is pivotally connected to the stanchion in journal bearing relationship by means such as a short shaft extending through a hub of the rocking beam and spanning the walls 51,52 at pivotal axis 61. The sheave axes 56,57 and the rocking axis 61 of the beam 48 are preferably parallel. Axis 61 is contained in a vertical plane A—A which generally bisects the spreader in a longitudinal direction and occurs preferably midway between the sheave axis 56,57.

Figure 3:
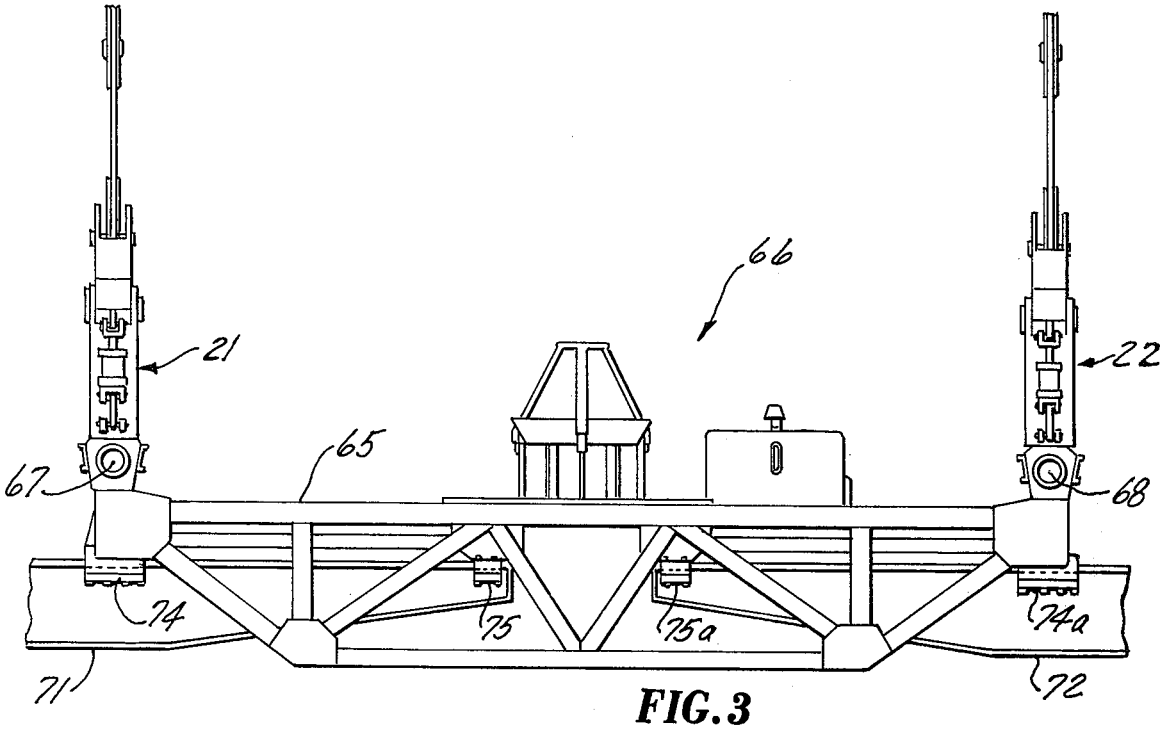
FIG. 3 is a fragmentary side elevation of an expandable type spreader incorporating the skewing mechanism of FIG. 1, and horizontally adjustable cantilever frames supported in telescoping relation with the main frame.

FIG. 3 illustrates the subframes 21,22 in hinged relation with a main frame 65 of a modified spreader 66. As shown, the subframes are hinged to the main frame at axes 67 and 68 extending in the crosswise or transverse direction of the main frame. The spreader 66 further comprises cantilever frames 71,72 which may move into or out of telescoping relation with the main frame through plate bearings 74, 75, *74a, 75a* fixed to the main frame. The cantilever frames 71,72 have latch assemblies attached to respective outer corner portions in a known manner for interlocking with the top latch receiving receptacles of a cargo container. Obviously, the subframes 21,22 characterizing the present invention are compatible with expandable spreader construction.

Figure 2:
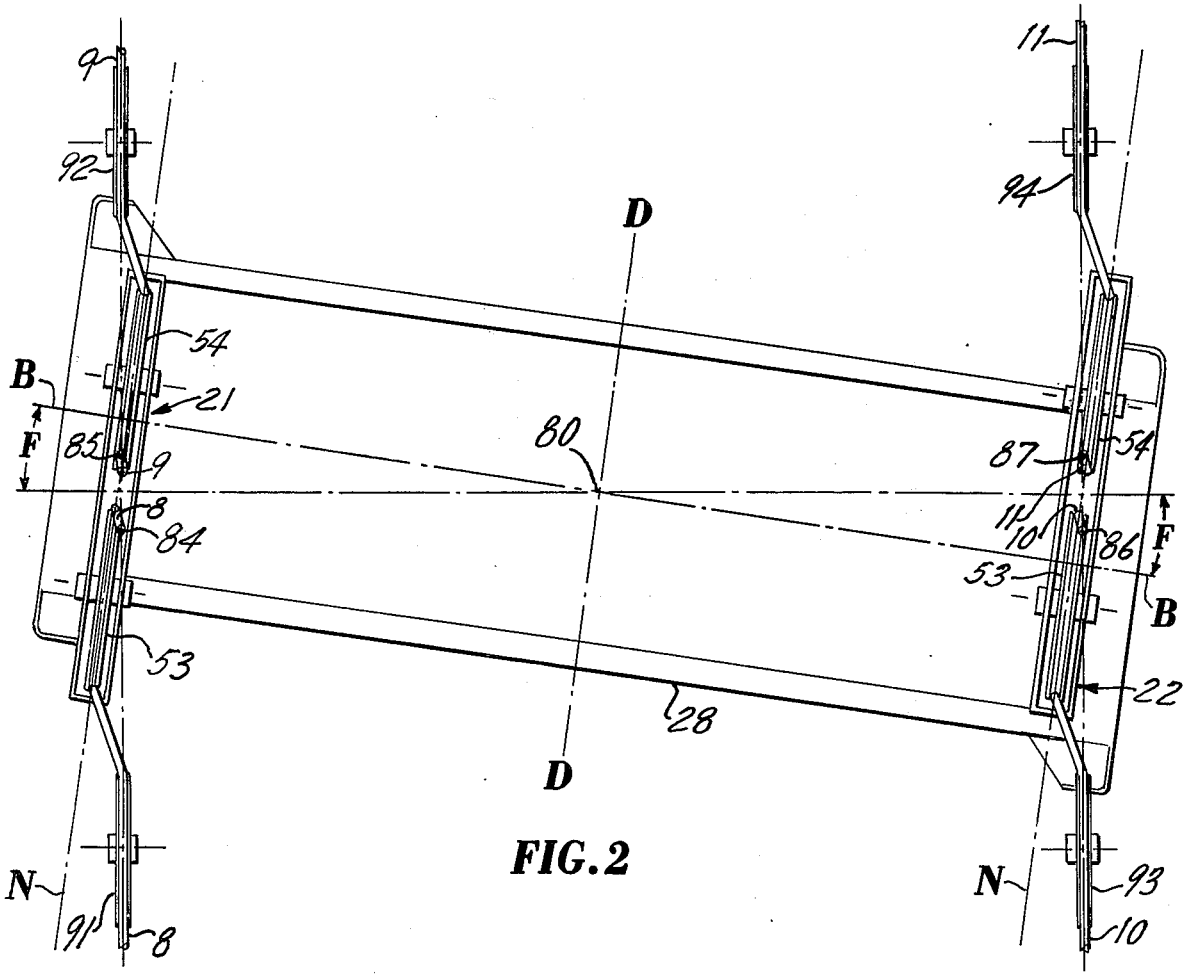
FIG. 2 is a shortened, schematic plan view of the main frame of a spreader in skewed relation with crane sheaves for the purpose of showing geometric relationships existing between a crane and a spreader having portions in skewed relation therewith.

In operation, skewing is effected by shifting the subframes 21,22 in opposite directions relative to the longitudinal axis B—B of the main frame, as shown in FIG. 2. This is accomplished by controlled admission of fluid, preferably a liquid, to respective cylinders 36 of both subframes. Best results in the skewing of the main frame relative to the subframes is obtained by controlling the movement of the subframes relative to the main frame to bring about rotation of the main frame about a vertical axis 80 perpendicular to the transverse axis D—D and its longitudinal axis B—B. As shown in FIGS. 1 and 2, the spreader is suspended on four loops of symmetrically arranged cables. For example, each cable 8, 9, 10, 11 extends downward from an anchor point 84, 85, 86 or 87, fixed on the crane around the spreader sheave 53 or 54 immediately below and upward to the respective crane sheave 91, 92, 93 or 94. In adjusting the spreader to a skewed position, gravity will require that the subframes 21, 22 remain directly under the cable supporting points on the crane as nearly as possible except for the minor twisting about a vetical axis of each subframe apparent in FIG. 2. During such adjustment, the main frame of the spreader shifts to a skewed position wherein its longitudinal axis takes an angle F with respect to the unskewed position of the main frame.

Tilting or listing function of the spreader is achieved through operation of the fluid motors 44,45. To achieve tilting the power motors 44,45 of both subframes 21,22 at one side of the vertical bisecting plane A—A are either shortened or lengthened while simultaneously the fluid cylinders 45 at the other side of the plane A—A are correspondingly lengthened or shortened, respectively, by appropriate exchanges of fluid between opposite ends of the fluid containing cylinders of the various power cylinders. With attention to FIG. 4, for example, extension of the fluid motors on one side of plane A—A and shortening of the fluid motors on the other side of this plane will result in a corresponding tilting of the stanchion 58 and the main frame 28 connected therewith. Optionally, either motor 44 or 45 may be eliminated and the other retained to function in place of the two motors of each subframe, although the two tilting motors on each subframe are a preferred arrangement.

With the structure described above for effecting both skewed and tilted positions of the main frame with respect to the subframes, an operator's skill may be readily developed to the point of simultaneously combining both listing and skewing movements of the main frame of the spreader. In addition, a crane of the type shown in FIG. 1 has the facility for lengthening or shortening the cables to one of subframes 21,22 relative to the cables supporting the other subframe to raise or lower one end of the spreader. This type of motion may be combined with the above described spreader maneuvering movements to provide completely universal maneuverability of the spreader main frame and its load relative to the supporting crane or a place to deposit a cargo container.

While the spreaders described above are disclosed as including sheaves by which the spreaders are suspended on looped cables terminating in the crane, the invention is of sufficient breadth to include a four point suspension comprising four single cables terminating in the spreader rocking beams. If the subframes do not include rocking beams, the cables may terminate otherwise in the subframes with the take-up means for the cables in the crane thereby eliminating the need for sheaves in the spreader. The use of other types of cranes providing pendant support, such as a crane constructed on the fork-lift plan which provides cantilever support of a load with its cantilever means adapted to be fixed to the subframes 21 and 22, is within the practice of this invention.

What is claimed is:

1. In combination with a crane, a cargo container spreader comprising:

a main frame having longitudinal and transverse axis and means for connecting with a cargo container positioned underneath the frame;

a pair of normally upright subframes having means adapting them for separate supported pendant relation with said crane;

portions of each subframe and said main frame being pivotally connected to define separate hinge means, each hinge means attaching one of said subframes to said main frame along one of two axes parallel to, and spaced at opposite sides of, said transverse axis, said hinge means being constructed for relative movement of the main frame and each subframe lengthwise of the respective hinge axis; and first power means operatively connected to each subframe and said main frame for reacting therebetween to effect said relative movement of the respective assembly and the main frame; and separate vertically adjustable means for pendantly connecting each subframe with said crane, said adjustable means being independently adjustable to raise and lower each end of the spreader relative to its other end.

2. The combination of claim 1 wherein:

each subframe comprises an upper rocking beam and a lower stanchion terminating downwardly in said hinge means and upwardly in journal bearing relation with the middle portion of said beam along an axis extending parallel to the longitudinal axis of said main frame; and second power means operatively connected to said beam and said stanchion and reacting therebetween to effect relative angular advance and return movements of said beam and said stanchion; and means on opposite end portions of each beam for separate connection with said crane.

3. The combination of claim 2 adapted for four point suspension wherein:

each subframe comprises an upper rocking beam and a lower stanchion terminating downwardly in said hinge means and upwardly in journal bearing relation with a middle portion of said beam along an axis extending parallel to said main frame longitudinal axis, and second power means operatively connected to said beam and said stanchion and reacting therebetween to effect relative angular advance and return movements of said beam and said stanchion;

each beam comprising cable receiving means on opposite end portions for separate cable connection with said crane.

4. The combination of claim 3 wherein:

said second power means comprises a pair of cylindrical fluid power motors of which upper termini are connected to opposite end portions of the beam and lower termini are connected to portions of the stanchion spaced directly underneath respective end portions of the beam.

5. The combination of claim 3 wherein:

said cable receiving means comprise two sheaves received in each beam within the opposite end portions thereof.

6. The combination of claim 3 wherein:

said beam comprises two spaced parallel walls, and each beam contains a pair of sheaves received therebetween at opposite sides of said journal bearing means as said cable receiving means, and the axes of said sheaves and said journal bearing means are generally parallel.

7. The combination of claim 2 wherein:

said power means comprises a pair of cylindrical fluid power motors, each aligned in association with one of said subframes lengthwise of the associated hinge axis and having one terminus connected with the subframe and the other terminus connected with the main frame.

8. The combination of claim 2 wherein:

each subframe comprising upright parallel walls spaced to receive said first power means, said journal bearing means, and a portion of said beam connecting with said journal bearing means.

9. The combination of claim 2 wherein:

said means for connecting with a cargo container comprises a pair of cantilever frames supported by said main frame in telescoping relation therewith for movements into and out of the main frame.

* * * * *